US006744040B2

(12) United States Patent
Park

(10) Patent No.: US 6,744,040 B2
(45) Date of Patent: Jun. 1, 2004

(54) MEANS AND METHOD FOR A QUADRUPOLE SURFACE INDUCED DISSOCIATION QUADRUPOLE TIME-OF-FLIGHT MASS SPECTROMETER

(75) Inventor: Melvin A. Park, Billerica, MA (US)

(73) Assignee: Bruker Daltonics, Inc., Billerica, MA (US)

( * ) Notice: Subject to any disclaimer, the term of this patent is extended or adjusted under 35 U.S.C. 154(b) by 210 days.

(21) Appl. No.: 09/880,717

(22) Filed: Jun. 13, 2001

(65) Prior Publication Data

US 2003/0042412 A1 Mar. 6, 2003

(51) Int. Cl.[7] ..... H01J 49/06

(52) U.S. Cl. ..... 250/281; 250/288

(58) Field of Search ..... 250/281, 288

(56) References Cited

U.S. PATENT DOCUMENTS

| | | | | |
|---|---|---|---|---|
| 4,731,532 A | | 3/1988 | Frey et al. | |
| 5,179,278 A | | 1/1993 | Douglas | |
| 5,652,427 A | | 7/1997 | Whitehouse et al. | |
| 5,698,375 A | | 12/1997 | Park et al. | |
| 5,763,878 A | | 6/1998 | Franzen | |
| 5,847,386 A | | 12/1998 | Thomson et al. | |
| 6,040,575 A | * | 3/2000 | Whitehouse et al. | 250/288 |

OTHER PUBLICATIONS

Nikolaev et al., "Comparison of keV CID in a Hybrid Sector–TOF with eV SID", Proceedings of the 46th ASMS Conference on Mass Spectrometry and Allied Topics, p. 41 (1998).

C. Gu et al., "Surface–Induced Dissociation (SID) using CF3(CH2)n– Terminated and Perfluorinated Langmuir-Blodgett (L–B) Films", Proceedings of the 46th ASMS Conference on Mass Spectrometry and Allied Topics, p. 72 (1998).

Zhong et al., "Tandem Fourier Transform Mass Spectrometry Studies of Surface–Induced Dissociation of Benzene Monomer and Dimer Ions on a Self–Assembled Fluorinated Alkanethiolate Monolayer Surface." Anal. Chem. 69(13), 2496(1997).

Wysocki et al.,Proceedings of the 47th ASMS Conference on Mass Spectrometry and Allied Topics, p. 2834, 2144, 1040, and 2299 (1999).

A. Dongre and V. Wysocki, "Linkage Position Determination of Lithium–cationized Disaccharides by Surface–Induced Dissociation Tandem Mass Spectrometry." Org. Mass Spectrom. 29, 700(1994).

T. Kane et al., "Neutralization of Polyatomic Ions at Self-Assembled Monolayer Surfaces before and after Electrodeposition of Poly(phenylene oxide)." Langmuir, 13(25), 6722(1997).

(List continued on next page.)

*Primary Examiner*—Jack Berman
(74) *Attorney, Agent, or Firm*—Ward & Olivo

(57) ABSTRACT

A means and method are disclosed whereby ions from an ion source can be selected and transferred to a time-of-flight mass analyzer via an arrangement of multipoles in such a way that fragmented ions may be generated by collision-induced dissociation or surface-induced dissociation. First, ions from the source are collisionally cooled by a first multipole. Second, the m/z range of the ions is then selected by a second multipole (preferably a quadrupole). Third, the selected ions are allowed to collide with a "collision surface" capable of producing fragment ions. Fourth, these fragment ions are collisionally cooled in a third multipole and delivered into a TOF mass analyzer for subsequent analysis of the fragmented ions.

42 Claims, 5 Drawing Sheets

OTHER PUBLICATIONS

C. Gu and V. Wysocki, "Ion–Surface Reactions Involving Isotopically Labeled Langmuir–Blodgett Films." J. Am. Chem. Soc. 119(49), 12010(1997).

A. Somogyi et al., "Reactive Collisions of C6H6.+ and C6D6.+ at Self–Assembled Monolayer Films Prepared on Gold from n–Alkanethiols and a Fluorinated Alkanethiol: The Influence of Chain Length on the Reactivity of the Films and the Neutralization of the Projectile." J. Am. Chem. Soc. 115, 5275(1993).

T. Kane et al., "Use of Condensation Figures to Image Low–Energy Ion Beam Damage of Monolayer Films." Anal. Chem. 66, 3733(1994).

T. Kane and V. Wysocki, "Surface–induced dissociation and ion–surface reactions at insulating surfaces." Int. J. Mass Spectrom. Ion Process 140, 177(1994).

V. Wysocki et al., "Surface–induced Dissociation in Tandem Quadrupole Mass Spectrometers: A Comparison of Three Designs." Am. Soc. Mass Spectrom. 3, 27(1992).

H. R. Morris et al., "High Sensitivity Collisionally–activated Decomposition Tandem Mass Spectrometry on a Novel Quadrupole/Orthogonal–acceleration Time–of–flight Mass Spectrometer", Rapid Commun. Mass Spectrom. 10, 889 (1996).

V. Wysocki et al., "Surface–induced Dissociation in Tandem Quadrupole Mass Spectrometers: A Comparison of Three Designs", Am. Soc. Mass Spectrom. 3, 27 (1992).

* cited by examiner

AVALG @ 35 eV

AVALG

MEANS AND METHOD FOR A QUADRUPOLE SURFACE INDUCED DISSOCIATION QUADRUPOLE TIME-OF-FLIGHT MASS SPECTROMETER

TECHNICAL FIELD OF THE INVENTION

The present invention relates generally to means and method whereby ions from an ion source are selectively transmitted through a multipole apparatus having the capability of producing ion fragments via collisions with a surface or a gas to be readily analyzed by a TOF mass spectrometer. More specifically, a method and apparatus are described which use a plurality (preferrably three) of multipole devices, a collision surface (for SID), and/or a collision gas (for CID) to produce fragment ions of a selected m/z range for subsequent mass analysis.

BACKGROUND OF THE PRESENT INVENTION

The present invention relates to a multipole ion system with a collision surface for use in TOF mass spectrometry. The methods for transmitting ions and producing ion fragments described herein are enhancements of the techniques that are referred to in the literature relating to mass spectrometry.

Mass spectrometry is an important tool in the analysis of a wide range of chemical compounds. Specifically, mass spectrometers can be used to determine the molecular weight of sample compounds. The analysis of samples by mass spectrometry consists of three main steps—formation of gas phase ions from sample material, mass analysis of the ions to separate the ions from one another according to ion mass, and detection of the ions. A variety of means exist in the field of mass spectrometry to perform each of these three functions. The particular combination of means used in a given spectrometer determine the characteristics of that spectrometer.

To mass analyze ions, for example, one might use a magnetic (B) or electrostatic (E) analyzer. Ions passing through a magnetic or electrostatic field will follow a curved path. In a magnetic field the curvature of the path will be indicative of the momentum-to-charge ratio of the ion. In an electrostatic field, the curvature of the path will be indicative of the energy-to-charge ratio of the ion. If magnetic and electrostatic analyzers are used consecutively, then both the momentum-to-charge and energy-to-charge ratios of the ions will be known and the mass of the ion will thereby be determined. Other mass analyzers are the quadrupole (Q), the ion cyclotron resonance (ICR), the time-of-flight (TOF), and the quadrupole ion trap analyzers.

Before mass analysis can begin, however, gas phase ions must be formed from sample material. If the sample material is sufficiently volatile, ions may be formed by electron impact (EI) or chemical ionization (CI) of the gas phase sample molecules. For solid samples (e.g. semiconductors, or crystallized materials), ions can be formed by desorption and ionization of sample molecules by bombardment with high energy particles. Secondary ion mass spectrometry (SIMS), for example, uses keV ions to desorb and ionize sample material. In the SIMS process a large amount of energy is deposited in the analyte molecules. As a result, fragile molecules will be fragmented. This fragmentation is undesirable in that information regarding the original composition of the sample—e.g., the molecular weight of sample molecules—will be lost.

For more labile, fragile molecules, other ionization methods now exist. The plasma desorption (PD) technique was introduced by Macfarlane et al. in 1974 (Macfarlane, R. D.; Skowronski, R. P.; Torgerson, D. F., *Biochem. Biophys. Res Commoun.* 60 (1974) 616). Macfarlane et al. discovered that the impact of high energy (MeV) ions on a surface, like SIMS would cause desorption and ionization of small analyte molecules, however, unlike SIMS, the PD process results also in the desorption of larger, more labile species—e.g., insulin and other protein molecules.

Lasers have been used in a similar manner to induce desorption of biological or other labile molecules. See, for example, VanBreeman, R. B.: Snow, M.: Cotter, R. J., Int. J. *Mass Spectrom. Ion Phys.* 49 (1983) 35; Tabet, J. C.; Cotter, R. J., *Anal. Chem.* 56 (1984) 1662; or Olthoff, J. K.; Lys, I.: Demirev, P.: Cotter, R. J., *Anal. Instrument.* 16 (1987) 93. Cotter et al. modified a CVC 2000 time-of-flight mass spectrometer for infrared laser desorption of involatile biomolecules, using a Tachisto (Needham, Mass.) model 215G pulsed carbon dioxide laser. The plasma or laser desorption and ionization of labile molecules relies on the deposition of little or no energy in the analyte molecules of interest. The use of lasers to desorb and ionize labile molecules intact was enhanced by the introduction of matrix assisted laser desorption ionization (MALDI) (Tanaka, K.; Waki, H.; Ido, Y.; Akita, S.; Yoshida, Y.; Yoshica, T., *Rapid Commun. Mass Spectrom.* 2 (1988) 151 and Karas, M.; Hillenkamp, F., *Anal. Chem.* 60 (1988) 2299). In the MALDI process, an analyte is dissolved in a solid, organic matrix. Laser light of a wavelength that is absorbed by the solid matrix but not by the analyte is used to excite the sample. Thus, the matrix is excited directly by the laser, and the excited matrix sublimes into the gas phase carrying with it the analyte molecules. The analyte molecules are then ionized by proton, electron, or cation transfer from the matrix molecules to the analyte molecules. This process, MALDI, is typically used in conjunction with time-of-flight mass spectrometry (TOFMS) and can be used to measure the molecular weights of proteins in excess of 100,000 daltons.

Time-of-flight mass spectrometry (or TOFMS) plays an important role in the analysis of chemical compounds. Specifically, TOF mass spectrometers are useful in determining the molecular weight of sample compounds. In orthogonal TOF mass spectrometers ions pass from the source into the analyzer in a direction which is orthogonal to the axis of the analyzer. The concept of orthogonal acceleration using TOFMS was disclosed by O'Hallran et al. in 1964 (G. J. O'Halloran et al., *Determination of Chemical Species Prevalent in a Plasma Jet*. Technical Documentary Report No. ASD-TDR-62-664, prepared under contract AF 33(616)-8374 by the Bendix Corp. Research Laboratories (1964)). O'Hallran et al. also introduced the application of TOF mass analysis to ionization sources at elevated pressure. One advantage to using orthogonal acceleration and elevated pressure ionization sources is that ions form a continuous beam and can be mass analyzed more efficiently. Also, with the "orthogonal acceleration" method, the mass analysis occurs along an axis which is orthogonal to the ion's initial direction of motion. As a result, the initial energy of the ions does not significantly degrade the mass resolution of the instrument.

Chien and Lubman demonstrated the advantage of using a quadrupole ion trap—TOF mass analyzer in the analysis of electrospray produced ions (Chien, B. M.; Lubman, D. M., *Anal. Chem.* 66, 1630(1994)). The ions from the electrospray source are transferred with a high efficiency to the TOF analyzer and ions may be preselected and collision induced dissociation on these ions may be performed. One disadvantage with this method is low mass resolving power. Also, there are restrictions in the time required for cooling the ions and cycling the pressure in the ion trap.

Chernushevich et al discloses the use of ion introduction into an RF-quadrupole ion guide at a high gas pressure (I. V. Chernushevich, Proceedings of the 44th ASMS Conference of Mass Spectrometry and Allied Topics, May 12–16, 1173 (1996)). Similarly, Douglas discloses ion introduction into a quadrupole ion trap rather than a TOF analyzer (D. J. Douglas, U.S. Pat. No. 5,179,278). Here, the ions are cooled by passage through the quadrupole at elevated pressure and are then transferred into a low pressure region containing a quadrupole trap analyzer. This "collisional focusing" method has also been incorporated with the "orthogonal acceleration" method in TOF mass spectrometry to obtain a higher resolution mass spectrum.

Morris et al. discloses the use of additional multipole devices to preselect ions and induce collision dissociation in the trap—TOF analyzer (H. R. Morris et al., *Rapid Comm. Mass Spectrom.* 10, 889(1996)). Their first multipole device is used to cool ions then a second multipole is used for mass selection, and a third multipole is used for collision induced dissociation. Collision induced dissociation experiments were also disclosed in Lubman (B. M. Chien, S. M. Michael, D. M. Lubman, *Int J. Mass Spectrom. Ion Process.,* 131, 149 (1994), B. M. Chien, D. M. Lubman, *Anal. Chem.* 66, 1630 (1994)).

Ions extracted from a multipole device and orthogonally accelerated in the direction of the axis of the analyzer will have a significant kinetic energy orthogonal to the axis of the analyzer. This initial kinetic energy will cause the ions to drift perpendicularly to the analyzer axis. This kinetic energy must be accounted for in order to prevent ion loss and to ensure ion detection. M. A. Park discloses a multideflector for correcting for such kinetic energies by deflecting the ion beam on the analyzer axis (U.S. Pat. Nos. 5,696,375 and 6,107,625).

Also, during the extracting process, the kinetic energy component of ions in the direction along the axis of the TOF analyzer—and therefore orthogonal to the axis of the multipole ion guide—will have a strong influence on the resolution that can be achieved by a TOF analyzer. To achieve best results, ions should be have near thermal kinetic energies—achieved by cooling in the ion guide.

High efficiency in transmitting ions from a multipole to a TOF analyzer requires that the spatial extent of the ion beam perpendicular to the axis of the analyzer be large compared to, for example, that of prior art MALDI-TOF designs. As a result, some prior art devices (i.e. the two stage reflectron taught by R. Frye in U.S. Pat. No. 4,731,532) cannot be used with the orthogonal multipole orthogonal TOF instruments described above.

An alternative "method and device for orthogonal ion injection into a time-of-flight mass spectrometer", proposed in Franzen U.S. Pat. No. 5,763,878 (the "'878 patent"). According to the '878 patent, ions are ejected from a multipole ion guide of design similar to that of Chernushevich et al. into a time-of-flight analyzer and in a direction orthogonal to the axis of the multipole device. In trapping mode an RF potential is applied to the poles of the multipole device whereas in ejection mode, DC potentials are applied to the poles of the multipole device so as to accelerate the ions in a direction orthogonal to the axis of the multipole device and parallel to the axis of the TOF analyzer.

Atmospheric pressure ionization (API) includes a number of methods. Typically, analyte ions are produced from liquid solution at atmospheric pressure. One of the more widely used methods, known as electrospray ionization (ESI), was first suggested by Dole et al. (M. Dole, L. L. Mack, R. L. Hines, R. C. Mobley, L. D. Ferguson, M. B. Alice, *J. Chem. Phys.* 49, 2240, 1968). In the electrospray technique, analyte is dissolved in a liquid solution and sprayed from a needle. The spray is induced by the application of a potential difference between the needle and a counter electrode. The spray results in the formation of fine, charged droplets of solution containing analyte molecules. In the gas phase, the solvent evaporates leaving behind charged, gas phase, analyte ions. Very large ions can be formed in this way. Ions as large as 1 MDa have been detected by ESI in conjunction with mass spectrometry (ESMS).

ESMS was introduced by Yamashita and Fenn (M. Yamashita and J. B. Fenn, *J. Phys. Chem.* 88, 4671, 1984). To establish this combination of ESI and MS, ions had to be formed at atmospheric pressure, and then introduced into the vacuum system of a mass analyzer via a differentially pumped interface. The combination of ESI and MS afforded scientists the opportunity to mass analyze a wide range of samples. ESMS is now widely used primarily in the analysis of biomolecules (e.g. proteins) and complex organic molecules.

In the intervening years a number of means and methods useful to ESMS and API-MS have been developed. Specifically, much work has focused on sprayers and ionization chambers. In addition to the original electrospray technique, pneumatic assisted electrospray, dual electrospray, and nano electrospray are now also widely available. Pneumatic assisted electrospray (A. P. Bruins, T. R. Covey, and J. D. Henion, Anal. Chem. 59, 2642, 1987) uses nebulizing gas flowing past the tip of the spray needle to assist in the formation of droplets. The nebulization gas assists in the formation of the spray and thereby makes the operation of the ESI easier. Nano electrospray (M. S. Wilm, M. Mann, *Int. J. Mass Spectrom. Ion Processes* 136, 167, 1994) employs a much smaller diameter needle than the original electrospray. As a result the flow rate of sample to the tip is lower and the droplets in the spray are finer. However, the ion signal provided by nano electrospray in conjunction with MS is essentially the same as with the original electrospray. Nano electrospray is therefore much more sensitive with respect to the amount of material necessary to perform a given analysis.

An elevated pressure ion source always has an ion production region (wherein ions are produced) and an ion transfer region (wherein ions are transferred through differential pumping stages and into the mass analyzer). The ion production region is at an elevated pressure—most often atmospheric pressure—with respect to the analyzer. The ion production region will often include an ionization "chamber". In an ESI source, for example, liquid samples are "sprayed" into the "chamber" to form ions.

Once the ions are produced, they must be transported to the vacuum for mass analysis. Generally, mass spectrometers (MS) operate in a vacuum between $10^{-4}$ and $10^{-10}$ torr depending on the type of mass analyzer used. In order for the gas phase ions to enter the mass analyzer, they must be separated from the background gas carrying the ions and transported through the single or multiple vacuum stages.

The use of multipole ion guides has been shown to be an effective means of transporting ions through a vacuum system. Publications by Olivers et al. (Anal. Chem, Vol. 59, p. 1230–1232, 1987), Smith et al. (Anal. Chem. Vol. 60, p. 436–441, 1988) and Douglas et al. U.S. Pat. No. 4,963,736

(Douglas) have reported the use of AC-only quadrupole ion guides to transport ions from an API source to a mass analyzer. Such multipole ion guides may be configured as collision cells capable of being operated in RF only mode with a variable DC offset potential applied to all rods. Thomson et al., U.S. Pat. No. 5,847,386 (Thomson) also describes a quadrupole ion guide. The ion guide of Thomson is configured to create a DC axial field along its axis to move ions axially through a collision cell, inter alia, or to promote dissociation of ions (i.e., by Collision Induced Dissociation (CID)).

Further, mass spectrometers similar to that of Whitehouse et al. U.S. Pat. No. 5,652,427, entitled "Multipole Ion Guide for Mass Spectrometry", (Whitehouse) use multipole RF ion guides to transfer ions from one pressure region to another in a differentially pumped system. In the source of Whitehouse, ions are produced by ESI or APCI at substantially atmospheric pressure. These ions are transferred from atmospheric pressure to a first differential pumping region by the gas flow through a glass capillary. Ions are transferred from this first pumping region to a second pumping region through a "skimmer" by an electric field between these regions as well as gas flow. A multipole in the second differentially pumped region accepts ions of a selected mass/charge (m/z) ratio and guides them through a restriction and into a third differentially pumped region. This is accomplished by applying AC and DC voltages to the individual poles.

A four vacuum stage ES/MS quadrupole mass spectrometer according to Whitehouse, incorporating a multipole ion guide beginning in one vacuum pumping stage and extending contiguously into an adjacent pumping stage, is depicted in FIG. 1. As discussed above, ions are formed from sample solution by an electrospray process when a potential is applied between spray needle 5 of sprayer 2 and sampling orifice 4. In other words, sample solution enters the ionization chamber through spray needle 5, at the end of which the solution is formed into a spray of fine droplets (not shown). The spray is formed as a result of an electrostatic field applied between spray needle 5 and sampling orifice 7. The sampling orifice may be an aperture, capillary, or other similar inlet leading into the differential pumping regions of the mass spectrometer. According to the prior art system shown in FIG. 1, capillary 16 is used to transport ions from atmospheric pressure region 1, where the ions are formed, to first pumping region 6. Lenses 10 and 14 are used to guide the ions from the exit end of capillary 16 through third pumping region 22 into a fourth pumping region 26 containing a mass analyzer—in this case a quadrupole mass analyzer.

Between lenses 10 and 30, an RF only hexapole ion guide 20 is used to guide ions through differential pumping stages 22 and 26 to exit 28 and into mass analysis region 32 through orifice 34. Ion guide 20 according to this prior art design is intended to provide for the efficient transport of ions from one location (i.e., the entrance of skimmer 14) to a second location (i.e., orifice 34). For the purpose of illustration, an electrospray ion source is shown as the API source. This could alternatively be an APCI or an ICP source.

Sample liquid is introduced through the electrospray needle 2 and is electrosprayed—either with or without pneumatic assistance—into chamber 1 as it exits needle 2. The charged droplets produced evaporate and desorb gas phase ions both in chamber 1 and as they are swept into vacuum through the annulus in capillary 16. A portion of the ions that enter first vacuum stage 6 through the capillary exit are focused through skimmer 14 with the help of lens 10 and the potential set on the capillary exit. Ions passing through skimmer 14 enter the multipole ion guide 20 which begins in vacuum pumping stage 22 and extends unbroken into vacuum stage 26. Ions falling within a certain m/z range—determined in part by the frequency and amplitude of the potentials applied to ion guide 20—which enter multipole ion guide 20 will be guided to multipole ion guide exit end 28 and will be focused by exit lens 30 into the TOF analyzer region 32 through orifice 34 for subsequent analysis. Whitehouse also discloses the use of collisional gas within ion guide 20 to cool the ions to thermal velocities through collisional cooling.

In the scheme of Whitehouse, an RF only potential is applied to ion guide 20. As a result, ion guide 20 is not "elective" but rather transmits ions over a broad range of mass-to-charge (m/z) ratios. Such a range as provided by prior art multipoles is inadequate for certain applications, such as for Matrix Assisted Laser Desorption/Ionization (MALDI), because the ions produced may be well out of this m/z range. In other words, high m/z ions such as are often produced by the MALDI ionization method are often out of the range of transmission of conventional multipole ion guides.

Thus, electric voltages usually applied to the conventional ion guide are used to transmit ions from an entrance end to an exit end. Analyte ions produced in the ion production region pass through a capillary or other ion transfer device to move the ions to a differentially pumped region and enter the ion guide at the entrance end. Through collisions with gas in the ion guide, the kinetic energy of the ions is reduced to thermal energies. Simultaneously, the RF potential on the poles of the ion guide forces ions to the axis of the ion guide. Then, ions migrate through the ion guide toward its exit end, where the ions typically either enter a second ion guide or enter the mass analysis region.

Whitehouse also discloses use of two or more ion guides in consecutive vacuum pumping stages to allow different DC and RF values. However, losses in ion transmission efficiency may occur in the region of static voltage lenses between ion guides. For example, a commercially available API/MS instrument manufactured by Hewlett Packard incorporates two skimmers and an ion guide. The region between the skimmers is pumped by the drag stage of the same turbopump which pumps the region containing the multipole ion guide. That is, an additional pumping stage/region is added without the addition of an extra turbo pump, and therefore, improved pumping efficiency may be achieved. In this dual skimmer design, there is no ion focusing device between skimmers, therefore ion losses may occur as the gases are pumped away. A second example is demonstrated by a commercially available API/MS instrument manufactured by Finnigan which applies an electrical static lens between capillary and skimmer to focus the ion beam. Due to narrow mass range of the static lens, the instrument may need to scan the voltage to optimize the ion transmission.

In addition, the electrode rods of the prior art multipole ion guides described above are positioned in parallel and are equally spaced at a common radius from the centerline of the ion guide. Thus, ions with a m/z ratio that fell within the ion guide stability window established by the applied voltages would have stable trajectories within the ion guide's internal volume bounded by the parallel, evenly spaced rods. This is true for quadrupoles, hexapoles, etc.

In other schemes a multipole might be used to guide ions of a selected m/z through the transfer region. For example, Morris et al., in H. R. Morris et al., High Sensitivity Collisionally Activated Decomposition Tandem Mass Spectrometry on a Novel Quadrupole/Orthogonal-Acceleration Time-of-Flight Mass Spectrometer, *Rapid Commun. Mass Spectrom.* 10, 889 (1996), use a series of multipoles in their design. One of these is a quadrupole. The quadrupole can be run in a "wide bandpass" mode or a "narrow bandpass" mode. In the wide bandpass mode, an RF-only potential is applied to the quadrupole and ions of a relatively broad range of m/z values are transmitted. In narrow bandpass mode both RF and DC potentials are applied to the quadrpole such that ions of only a narrow range of m/z values are selected for transmission through the quadrupole. In subsequent multipoles, the selected ions may be activated towards dissociation. In this way the instrument of Morris et al. is able to perform MS/MS experiments with a first mass analysis and subsequent fragmentation occurring in what would otherwise be simply a set of multipole ion guides.

Such a prior art ionization source according to Morris et al. is shown in FIG. 2. This prior art source design is similar to Whitehouse (as shown in FIG. 1), except for the multipole ion guide arrangement. In the prior art source design according to Morris et al., four RF multipoles 48, 50, 52 & 54 are used. The first multipole encountered by the ions is hexapole 48. It is used in a manner similar to the Whitehouse et al. to cool and guide the ions. The second multipole encountered is quadrupole 50. Quadrupole 50 can be used in a wide bandpass mode to transmit ions over a broad m/z range, or in a narrow bandpass mode to transmit ions of a selected narrow m/z range. This leads to the use of the mass spectrometer instrument in MS and MS/MS modes. In MS mode, quadrupole 50 is operated as a wide bandpass ion guide. Ions are simply transmitted by all four multipoles 48, 50, 52 & 54 to time-of-flight mass analyzer 62. The TOF mass analyzer 62 is then used to produce a mass spectrum. In MS/MS mode, quadrupole 50 is operated as a narrow bandpass ion guide to select ions of interest.

Further, the ions encounter a third multipole—hexapole 52—which is operated with a DC offset with respect to quadrupole 50 and contains a collision gas. This leads to collisions between the ions of interest and the collision gas and can result in the formation of fragment ions. Finally, the fragment ions are guided by a fourth multipole—hexapole 54—to TOF analyzer 62 which is then used to produce a mass spectrum of these fragment ions.

In the performance of tandem mass spectrometry experiments, precursor ions are selected and fragmented, and the fragment ions are analyzed to produce a fragment ion spectrum. In the prior art, a variety of methods have been used to fragment precursor ions. Among these are collision induced dissociation (CID) as mentioned above, surface induced dissociation (SID), infrared multiphoton dissociation (IRMPD), electron capture dissociation (ECD), and many others. Each of these methods has its advantages and disadvantages. For example, CID is a relatively simple technique and can be applied in a variety of instrument configurations (i.e. quadrupole, TOF, or FT-ICR analyzers). IRMPD is somewhat more complex in that a laser is required, but has the advantage that it produces no gas load on the vacuum system—as is the case in CID—and can produce fragment species that are inaccessible by CID. SID is also somewhat complex in that it is necessary that a "collision surface" be prepared and placed in the instrument. Also, SID is not readily adaptable to all types of analyzers. However, SID does provides better control over the fragmentation process and can lead to higher efficiency in the production of useful fragment ions.

Quadrupole mass analyzers have been used in conjunction with surface induced dissociation (SID). For example, Wysocki et al. discloses such an arrangement (Chungang GU, Vincent J. Angelico, Vicki H. Wysocki, Proceedings of the 46$^{th}$ ASMS conference on Mass Spectrometry and Allied Topics, pg. 72(1998), Wysocki et al., Proceedings of the 47$^{th}$ ASMS Conference on Mass Spectrometry and Allied Topics, pg. 2834, 2144, 1040, and 2299(1999), Ahok Dongre, Vicki Wysocki, *Org. Mass Spectrom.* 29, 700(1994), Thomas Kane, Vincent Angelico, and Vicki Wysocki, *Langmuir* 13, 6722(1997), Chungang Gu, Vicki Wysocki, *J. AM. Chem. Soc.* 119, 12010(1997), Arpad Somogyi, Thomas Kane, Jian-Mei Ding, Vicki Wysocki, *J. AM. Chem. Soc.* 115, 5275(1993), Thomas Kane, Vincent Angelico, Vicki Wysocki, *Anal. Chem.* 66, 3733(1994), Thomas Kane, Vicki Wysocki, *Int. J. Mass. Spectrom. Ion Process* 140, 177 (1994), Vicki Wysocki et al., *Am. Soc. Mass. Spectrom.* 3, 27(1992)). In such an arrangement, as shown in FIG. 3, first quadrupole 81 comprising rods 80 is used to select ions of a given m/z from a beam of incoming ions 78. The selected ions are allowed to collide with a SID "collision surface" 76 after passing through electrodes 82. The instrument according to Wysocki can be operated without fragmentation of the selected ions or with surface-induced dissociation of the selected ions. In SID, the ions are dissociated via energetic collisions with a prepared "collision surface". This collision results in the fragmentation of the selected ions into "fragment ions", and the fragment ions are extracted (and focused by electrodes 84) into second quadrupole 85 comprising rods 86. Second quadrupole 85 is used to analyze the these fragment ions.

In MS mode, or to produce simply a mass spectrum of the incident ion beam, first quadrupole 81 is scanned over the mass range of interest while second quadrupole 85 is operated in broad bandpass mode (i.e., RF only). The potential between the source (not shown) and collision surface 76 is held at zero volts. As a result, ions exiting first quadrupole 81 do not strike collision surface 76, but rather, these ions are deflected into second quadrupole 85 which transmits them to a detector (not shown).

In SID MS/MS mode, first quadrupole 81 is used to select ions of a given m/z out of the incident ion beam. These ions are allowed to strike collision surface 76. The kinetic energy of the ions when they strike surface 76 is determined largely by the potential difference between the ion source (not shown) and collision surface 76. Fragment ions resulting from the ion-surface collision are extracted by an electrostatic field into second quadrupole 85 where they are mass analyzed to produce a fragment ion spectrum.

For example, FIGS. 4A–D depict the operation of the O-SID-O instrument according to Wysocki without fragmentation due to SID (FIGS. 4A–B) and with fragmentation due to SID (FIGS. 4C–D). In MS mode, as shown in FIGS. 4A–B, no potential difference is applied between source 90 and collision surface 96. In this case, the ions are transmitted from source 90 through quadrupole 92, but do not strike collision surface 96 (as indicated by ion path 94) and do not produce fragment ions. The ions then enter quadrupole 98 for mass analysis. Therefore, because no fragment ions are produced, the resulting mass spectrum 120 shown in FIG. 4B contains a single peak 100—that of the incident beam.

In SID MS/MS mode, as shown in FIGS. 4C–D, a potential difference is applied between source 102 and collision surface 108. In this case, selected ions are transmitted from source 102 through ion guide 104, such that they strike collision surface 108 (at location 106 of the ion beam path). As a result of the collision, ion fragments of the initial ion beam are formed (as indicated at ion beam 110) and enter second quadrupole 112. Second quadrupole 112 is used to mass analyze the fragment ion. Once analyzed, these fragment ions then enter the detector (not shown). The resulting sharp peaks 114 of the mass spectrum 116 shown in FIG. 4D depicts multiple m/z values of the fragment ions.

The present invention provides means and method of using SID in conjunction with any mass analyzer—in the preferred embodiment, a TOF mass analyzer. More specifically, a first multipole (preferably a quadrupole) is used to select precursor ions, the ions are allowed to collide with a collision surface, and the fragment ions thereby produced are collisionally cooled in a second multipole and then mass analyzed in a mass analyzer (preferably a TOF mass analyzer). Further, a method and apparatus are described which use a plurality (preferably three) of multipole devices, a collision surface (for SID), and/or a collision gas (for CID) to produce fragment ions of a selected m/z range (i.e., using a Q-SID-Q or Q-CID-Q arrangement) for subsequent mass analysis (preferably in an orthogonal TOF mass analyzer).

SUMMARY OF THE INVENTION

The purpose of the present invention is to provide a tandem mass spectrometry instrument with improved performance characteristics over prior art instruments. Particularly, the preferred embodiment Q-SID-Q-TOF instrument according to the present invention is capable of surface induced dissociation, and collision induced dissociation. Thus, an instrument according to the present invention can be used to take advantage of the fragmentation characteristics of either of these methods. Also, because a TOF mass analyzer is used in the preferred embodiment, precursor and fragment ion spectra can be obtained rapidly—i.e. on a time scale consistent with hyphenation of the instrument with liquid chromatography.

Another object of the present invention is to provide a means of adapting surface induced dissociation to any type of mass analyzer. That is, SID is performed between two mulitpoles—e.g. Q-SID-Q—followed by mass analysis in a mass analyzer of choice—e.g. FT-ICR, quadrupole trap, etc.

Other objects, features, and characteristics of the present invention, as well as the methods of operation and functions of the related elements of the structure, and the combination of parts and economies of manufacture, will become more apparent upon consideration of the following detailed description with reference to the accompanying drawings, all of which form a part of this specification.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which:

FIG. 6 is a diagramatic representation of an alternate embodiment of the Q-SID-Q-TOF mass spectrometer according to the present invention.

DETAILED DESCRIPTION OF A PREFERRED EMBODIMENT

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention. The following presents a detailed description of a preferred embodiment (as well as some alternative embodiments) of the present invention.

Figure 1:
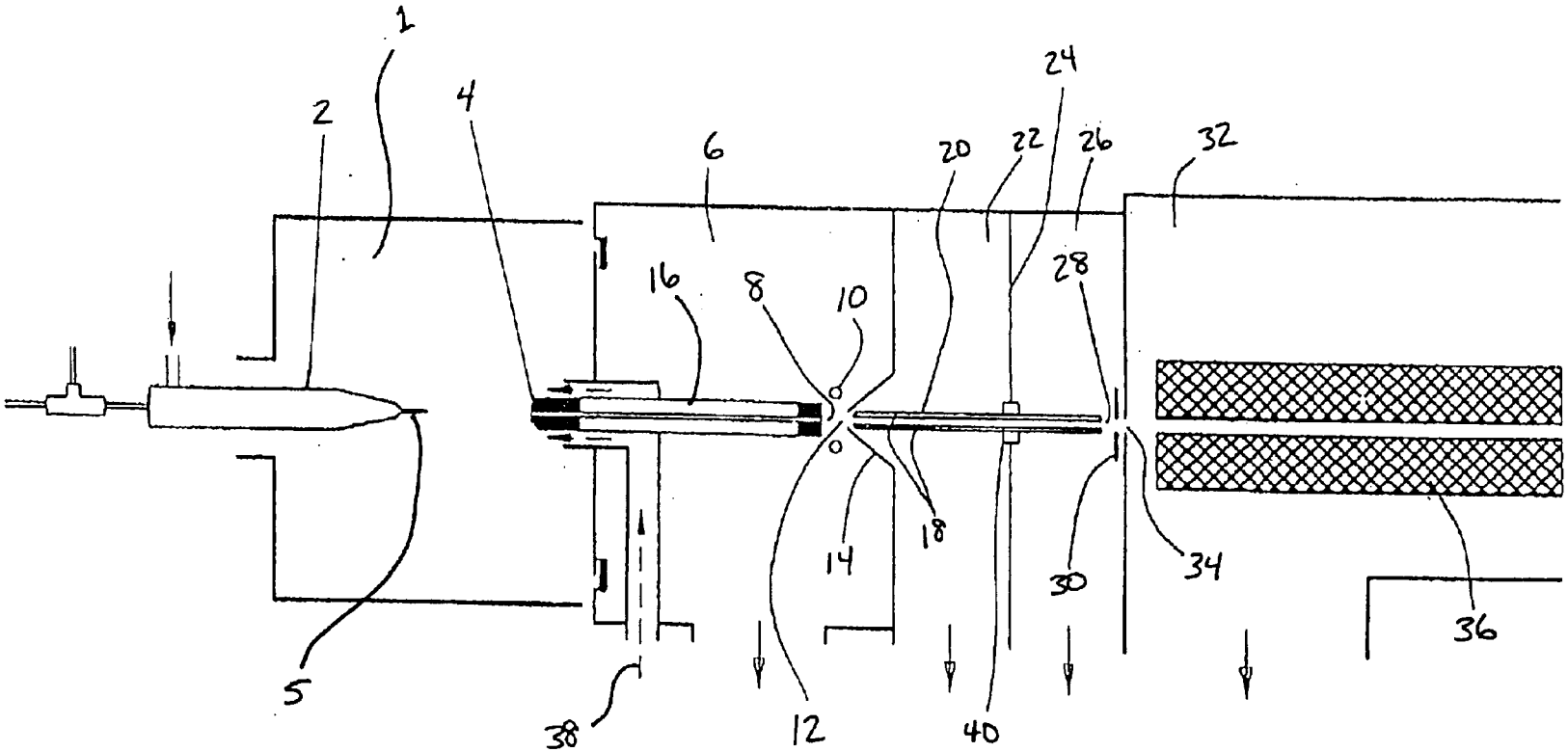
Figure 1 PRIOR ART
FIG. 1 shows a conventional four vacuum stage ES/MS quadrupole MS instrument according to Whitehouse.
Figure 2:
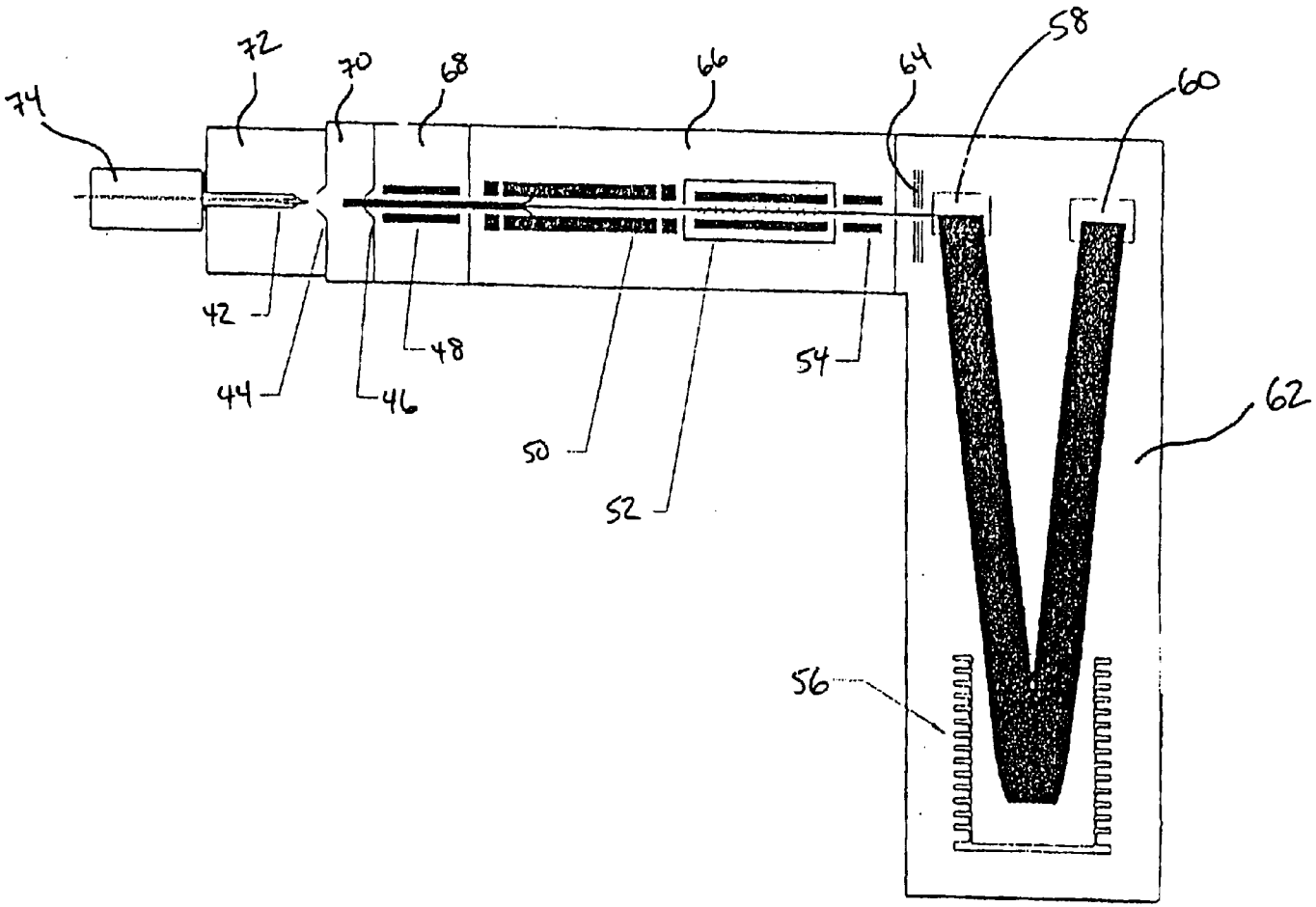
Figure 2 PRIOR ART
FIG. 2 shows a prior art ionization source design according to Morris.
Figure 3:
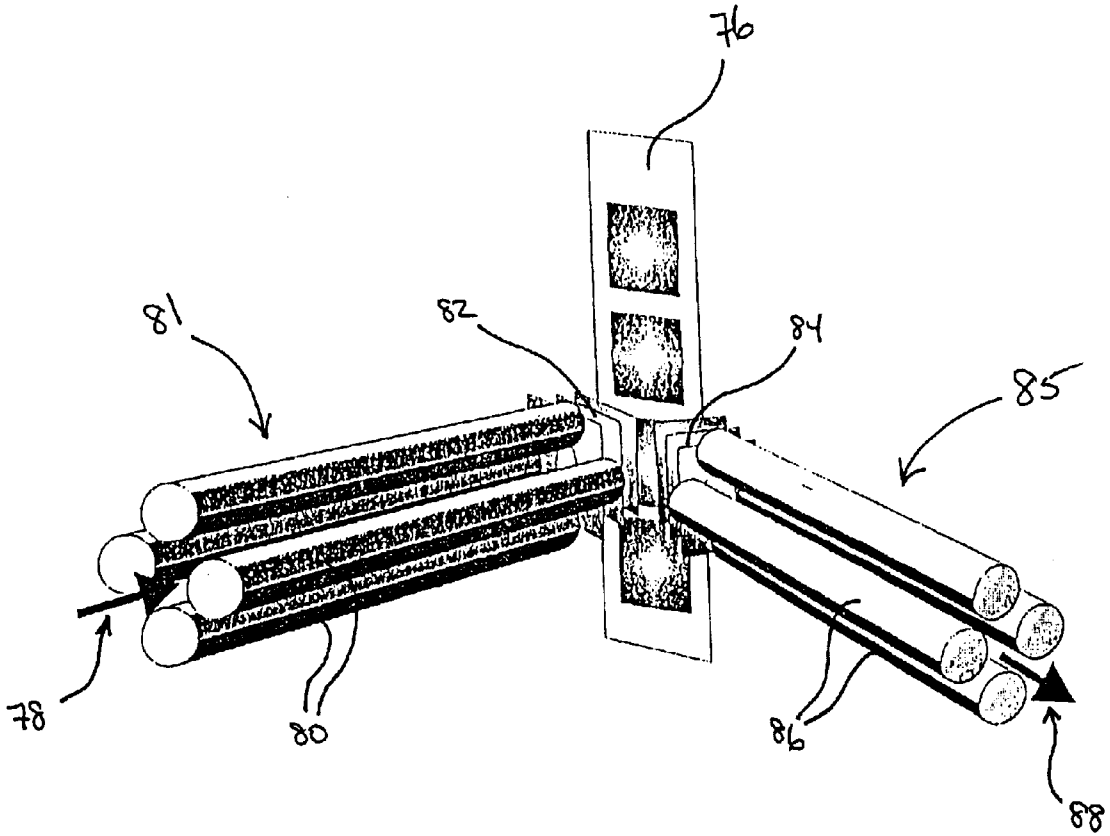
FIGURE 3 PRIOR ART
FIG. 3 is a schematic representation of a prior art Q-SID-Q instrument according to Wysocki.
Figure 4C:
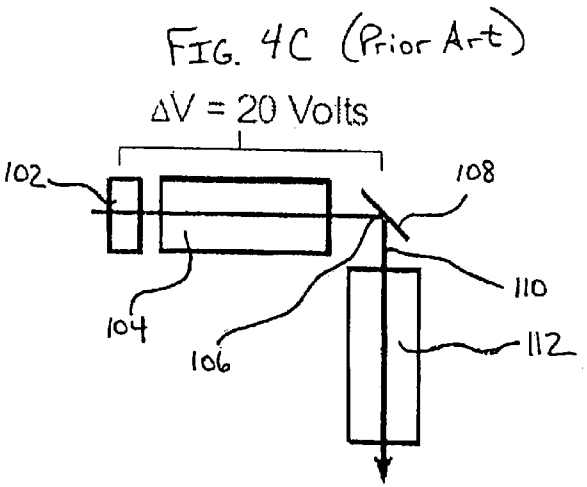
FIG. 4C (Prior Art)
FIGS. 4C and 4D depict the operation of the Q-SID-Q instrument of FIG. 3 with fragmentation (due to SID)
Figure 4D:
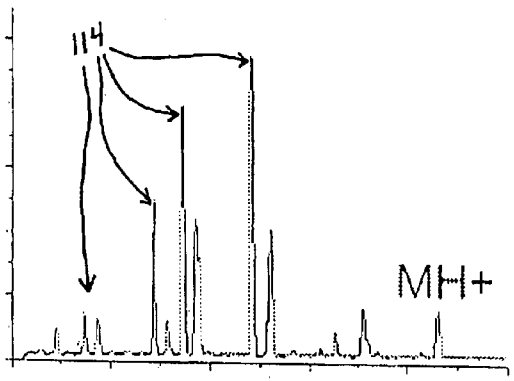
FIG. 4D (Prior Art)
Figure 4A:
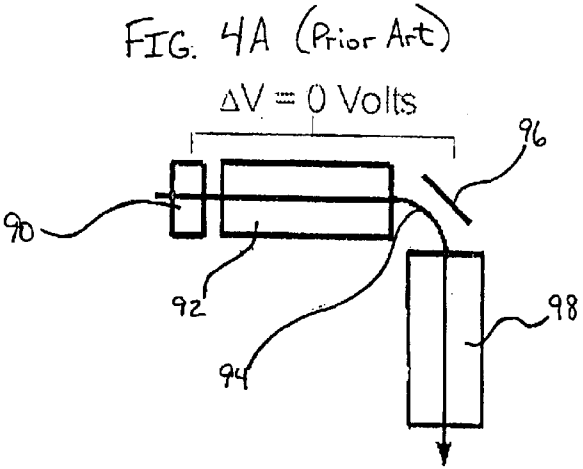
FIG. 4A (Prior Art)
FIGS. 4A and 4B depict the operation of the Q-SID-Q instrument of FIG. 3 without fragmentation.
Figure 4B:
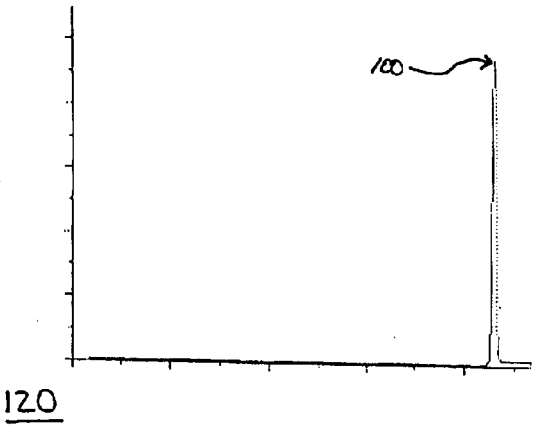
FIG. 4B (Prior Art)
Figure 5:
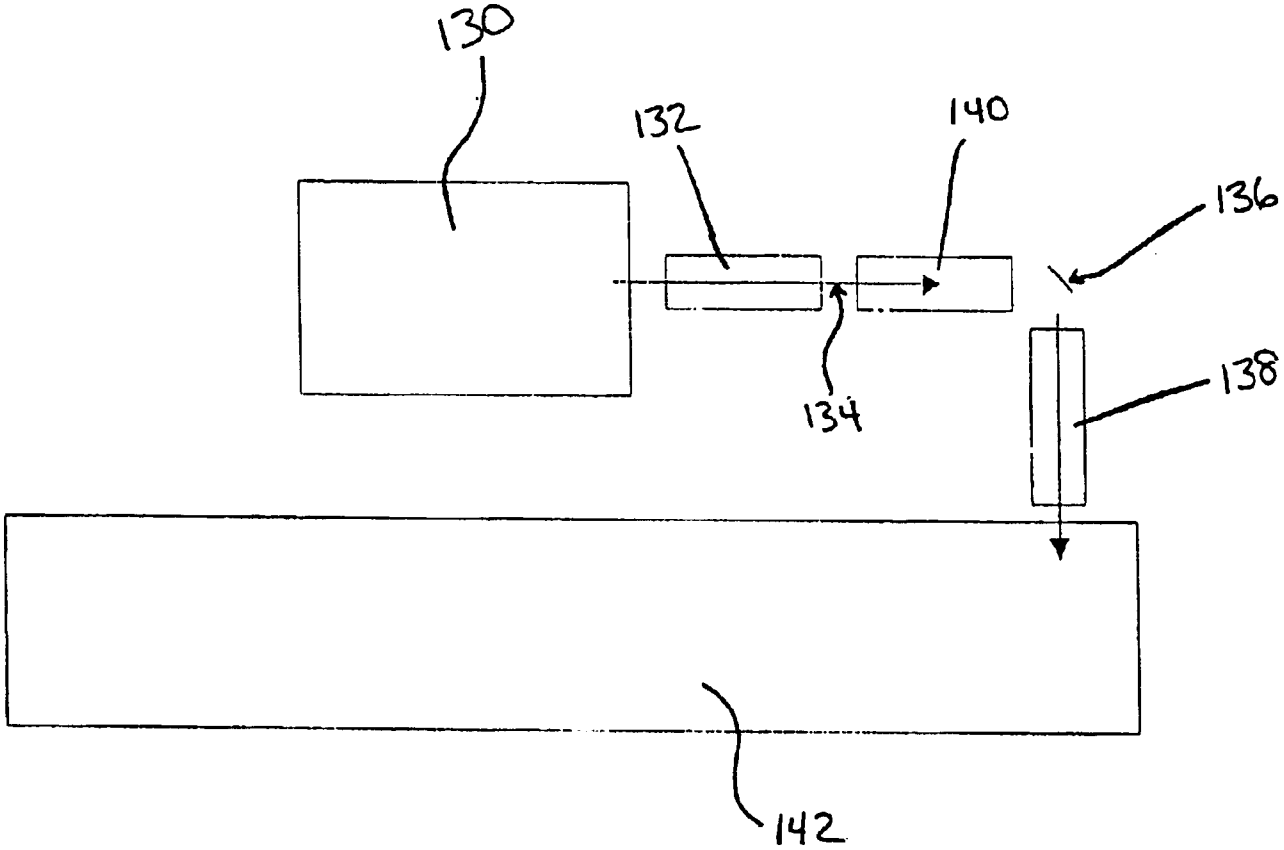
FIG. 5 is a diagramatic representation of the preferred embodiment of the Q-SID-Q-TOF mass spectrometer according to the present invention.

Referring first to FIG. 5, shown is diagramatic representation of the preferred embodiment of the Q-SID-Q-TOFMS according to the present invention. Specifically, the preferred embodiment of a quadrupole surface induced dissociation quadrupole time-of-flight ("Q-SID-Q-TOF") mass spectrometer according to the invention comprises ionization source 130, first multipole 132 (preferably a hexapole), second multipole (preferably a quadrupole) 140, collision surface 136 for surface induced dissociation (SID), third multipole 138 (which optionally acts as a collision cell for collision induced dissociation (CID)), and mass analyzer 142 (preferably a time of flight mass analyzer). Multipoles 132, 140, and 138 are preferably RF multipoles similar to the RF multipole ion guides know in the prior art.

As shown, first multipole 132 is disposed coaxial with and downstream of ion source 130. Second multipole 140 is disposed coaxial with and downstream of first multipole 132 and ion source 130, such that ions 134 are transported from ion source 130 through first multipole 132 into second multipole 140. Third multipole 138 preferably contains a collision gas and is positioned such that its axis is orthogonal to the axis of first and second multipoles 132 & 140. Collision surface 136 is disposed between second and third multipoles 140 & 138 with its normal vector at an angle (preferably 45°) to the axis of multipoles 140 & 138. Finally, TOF analyzer 142 is disposed downstream of (and preferably orthogonal to) third multipole 138.

In the preferred embodiment, ion source 130 is an electrospray ionization (ESI) source. Ions are produced at atmospheric pressure and introduced into the vacuum system of the instrument through an aperture or other opening in the vacuum housing. Multipoles 132, 140, and 138 and analyzer 142 are preferably disposed in different pumping regions of the vacuum system. Multipole 132 in a first pumping region is maintained at a pressure of $10^{-2}$–$10^{-3}$ mbar. Multipole 140 and collision surface 136, in a second pumping region, are maintained at a pressure of about $10^{-5}$ mbar. Multipole 138, in a third pumping region, is maintained at a pressure of $10^{-2}$–$10^{-3}$ mbar. In the preferred embodiment, the pressure in multipole 138 is achieved by "leaking" a desired collision gas (e.g. $N_2$, Ar, He, etc.) into the multipole. A dynamic equilibrium between the rate at which gas is leaked into the multipole and the rate at which it is pumped away and a desired pressure is thereby achieved. Analyzer 142 (preferably a TOF mass analyzer) is preferably maintained in a fourth pumping region at a pressure of $10^{-7}$ mbar or less.

In the present invention, ions may be generated in any conceivable ion source (i.e., an electrospray ionization source, matrix assisted laser desorption/ionization, chemical ionization, etc.). As these ions enter first multipole 132, they undergo collisions with the gas therein. These collisions cause the ions to lose kinetic energy and thereby to be cooled to near thermal velocities. First multipole 132 guides the ions from the source region to the entrance of second multipole 140.

In second multipole 140, ions of a desired mass-to-charge ratio (m/z) range are selected. Ions falling outside the desired m/z range are removed from the ion beam by the electric field of multipole 140. Second multipole 140 is preferably a quadrupole. To transmit ions over a broad range of m/z values, the DC potential between the quadrupole rods is set to 0V and multipole 140 is thereby operated in "RF only" mode. Multipole 140 is typically operated in RF only mode when generating a precursor ion spectrum. To select ions of a narrow m/z range, both RF and DC potentials are applied between the multipole rods as described extensively in the prior art. Multipole 140 is typically operated to select a narrow m/z range when generating a fragment ion spectrum.

In the performance of SID experiments, selected ions (aka. precursor ions) collide with collision surface 136 with a predefined collision energy. The collision surface may consist of a self assembled monolayer (preferably of straight chain hydrocarbons with fluorinated end groups). The preparation and use of collision surfaces for SID is described extensively in the literature. The predefined collision energy is given by the difference in the DC levels between multipole 132 and collision surface 136 (e.g. 20V). As detailed in prior art literature, a number of reactions can take place as a result of the ion-surface collision. Among these are neutralization, abstraction, and fragmentation. Products species (ideally fragment ions) are focused into multipole 138 by the potential difference between surface 136 and multipole 138 and by other ion optical elements (not shown) known in the prior art. Through collisions with gas in multipole 138, the fragment and remaining precursor ions are cooled to thermal energies. Multipole 138 guides the cooled ions to analyzer 142. Mass analyzer 142 (preferably a TOF analyzer) is then used to generate a mass spectrum of the ions—aka. a fragment ion spectrum.

Alternatively, in "MS only" analyses and in the performance of CID experiments, the DC potential difference between multipole 132 and collision surface 136 is maintained at 0V. Selected ions then do not collide with collision surface 136, but rather continue on into multipole 138. In "MS only" analyses, second multipole 140 is typically operated in RF only mode to transmit ions over a broad m/z range. The kinetic energy of ion entering multipole 138 is low—e.g. 5 eV. Through collisions with gas in multipole 138, the ions are again cooled to thermal energies. Multipole 138 guides the cooled ions to analyzer 142. Mass analyzer 142 (preferably a TOF analyzer) is used to generate a mass spectrum of the ions.

In the performance of CID experiments, the kinetic energy of ions entering multipole 138 is high—e.g. 100 eV. This kinetic energy is set by the DC potential difference between multipoles 132 and 138. Through initial collisions with gas (e.g. $N_2$, Ar, etc.) in multipole 138, ions are activated towards fragmentation. Fragment ions resulting from CID, as well as precursor ions, are then "cooled" to thermal energies via subsequent collisions with the gas in multipole 138. Multipole 138 also guides the ions into mass analyzer 142. Mass analyzer 142 (preferably a TOF analyzer) subsequently analyzes the fragment and precursor ions and produces a fragment ion spectrum.

Furthermore, alternate embodiments of the present invention are not limited to three multipoles. Multipoles consisting of any number of rods may be used instead of quadrupoles. Also, ions selected by multipole 140 may be used as primary ions in the production of secondary ions from surface 136. In this way, the instrument may be used for SIMS analysis of a solid sample. That is, samples are deposited on a holder to form surface 136. Ions selected by multipole 140 collide with the sample inducing the sputtering of sample ions from sample material composing surface 136. These ions are focused into multipole 138, cooled by collisions with the gas in multipole 138 and guided into analyzer 142. Mass analyzer 142 (preferably a TOF analyzer) then produces a mass spectrum from these ions—i.e. a secondary ion mass spectrum (SIMS).

Additionally, a laser may be used to perform MALDI experiments from surface 136. In this embodiment, MALDI samples are deposited on a holder to form surface 136. A laser is used to produce ions from the MALDI samples, and the MALDI ions are extracted into the multipole 138. These ions are focused into multipole 138, cooled by collisions with the gas in multipole 138 and guided into analyzer 142. Mass analyzer 142 (preferably a TOF analyzer) then produces a mass spectrum from these ions—i.e. a secondary ion mass spectrum (SIMS).

Additionally, an IR laser may be used to irradiate ions while they are in one of multipoles 132, 140, or 138 in order to perform "in source" IRMPD in the manner described by Steven Hoffstadler.

Finally, other types of mass analyzers may be used instead of TOF (e.g., FTICR, quadrupole ion traps, etc.).

Turning next to FIG. 6, shown is an alternate embodiment of the Q-SID-Q-TOFMS according to the present invention. Specifically, depicted is a diagramatic representation of a quadrupole surface induced dissociation quadrupole time-of-flight ("Q-SID-Q-TOF") mass spectrometer according to the invention comprising, similar to FIG. 5, ionization source 130, first multipole 132 (preferably a hexapole), second multipole (preferably a quadrupole) 140, collision surface 136 for surface induced dissociation (SID), third multipole 138 (which optionally acts as a collision cell for collision induced dissociation (CID)), and mass analyzer 142 (preferably a time of flight mass analyzer).

As shown in FIG. 6, the Q-SID-Q-TOF according to the invention may be used with a coaxial multiple reflection TOF mass analyzer 142, such as that described in U.S. Pat. No. 6,107,625, which is herein incorporated by reference. Such a mass analyzer 142 comprises an "orthogonal interface" with respect to the Q-SID-Q-TOF (i.e., ion guide 138 is positioned orthogonal to the axis of the TOF analyzer 142), a drift region 152, reflectron 154, detectors 144 and/or 156, accelerator 146, and optionally, multideflector 148, all oriented coaxially with one another. The mass analyzer accepts ions from the external ion source 130, via ion guides 132, 140 and 138, and accelerates them toward reflectron 154. If reflectron 154 is energized, the ions are reflected back toward detector 144. In this case the m/z of the ions are determined by the time required for the ions to travel from accelerator 146 to reflectron 154, to detector 144. If reflectron 154 is deenergized, ions travel directly from accelerator 146 to detector 156. Similarly, the m/z of the ions is determined by the time required to travel from accelerator 146 to detector 156. Although the TOF analyzer depicted in FIG. 6 is a "coaxial" analyzer design, it should be recognized that any other prior art TOF analyzer design might be substituted for the depicted analyzer.

While the present invention has been described with reference to one or more preferred embodiments, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. A mass spectrometer comprising:
an ionization source to produce ions;
a plurality of multipoles to cool, guide or select said ions;
a collision surface for fragmenting said ions; and
a mass analyzer to analyze said ions;
wherein said plurality of multipoles comprise first, second and third multipoles, and
wherein said collision surface is positioned between said second and third multipoles.

2. A mass spectrometer according to claim 1, wherein said ionization source is selected from the group consisting of electrospray ionization source, nanospray ionization source, microspray ionization source, matrix assisted laser desorption/ionization, electron ionization, chemical ionization and electron ionization.

3. A mass spectrometer according to claim 1, wherein said plurality of multipoles further comprise at least one quadrupole.

4. A mass spectrometer according to claim 1, wherein a potential is applied between said ionization source and said collision surface to allow said ions to undergo surface induced dissociation.

5. A mass spectrometer according to claim 1, wherein said mass analyzer is selected from the group consisting of time-of-flight (TOE) mass analyzer, fourier transform ion cyclotron resonance (FTICR) mass analyzer, quadrupole ion trap mass analyzer and coaxial multiple reflection TOF mass analyzer.

6. A mass spectrometer according to claim 1, wherein a potential is applied between said ionization source and said collision surface such that said ions pass through all of said multipoles without colliding with said collision surface.

7. A mass spectrometer according to claim 1, wherein at least one of said first, second or third multipole comprises a quadrupole.

8. A mass spectrometer according to claim 1, wherein said first and second multipoles are arranged coaxially.

9. A mass spectrometer according to claim 1, wherein said collision surface is positioned at an angle to a co-axis of said first and second multipoles.

10. A mass spectrometer according to claim 1, wherein said first multipole collisionally cools said ions.

11. A mass spectrometer according to claim 1, wherein a potential is applied between said ionization source and said collision surface such that said ions pass through all of said multipoles without colliding with said collision surface.

12. A mass spectrometer according to claim 1, wherein said third multipole contains a collision gas to fragment said ions.

13. A mass spectrometer according to claim 1, wherein said first multipole selects ions of a predetermined m/z range, wherein a potential is applied between said ionization source and said collision surface such that said selected ions will not collide with said collision surface, and wherein said third multipole contains a collision gas to fragment said selected ions.

14. A mass spectrometer comprising:
an ionization source to produce ions;
first, second and third multipoles to cool, guide or select said ions;
a collision surface for fragmenting said ions; and
a mass analyzer to analyze said ions;
wherein said first and second multipoles are arranged coaxially;
wherein said collision surface is positioned between said second and third multipoles; and
wherein said collision surface is positioned at an angle to said axis of said first and second multipoles.

15. A mass spectrometer according to claim 14, wherein at least one of said first, second or third multipole comprises a quadrupole.

16. A mass spectrometer according to claim 14, wherein said first and second multipoles are arranged coaxially.

17. A mass spectrometer according to claim 14, wherein said collision surface is positioned between said second and third multipoles.

18. A mass spectrometer according to claim 14, wherein said collision surface is positioned at an angle to a co-axis of said first and second multipoles.

19. A mass spectrometer according to claim 14, wherein said first multipole collisionally cools said ions.

20. A mass spectrometer according to claim 14, wherein a potential is applied between said ionization source and said collision surface such that said ions pass through all of said multipoles without colliding with said collision surface.

21. A mass spectrometer according to claim 14, wherein said third multipole contains a collision gas to fragment said ions.

22. A mass spectrometer according to claim 14, wherein said first multipole selects ions of a predetermined m/z range, wherein a potential is applied between said ionization source and said collision surface such that said selected ions will not collide with said collision surface, and wherein said third multipole contains a collision gas to fragment said selected ions.

23. A mass spectrometer according to claim 14, wherein said ionization source is selected from the group consisting of electrospray ionization source, nanospray ionization source, microspray ionization source, matrix assisted laser desorption/ionization, chemical ionization and electron ionization.

24. A mass spectrometer comprising:
at least one sample;
an ionization source to produce ions;
a plurality of multipoles to cool and guide said ions; and
a mass analyzer to analyze said ions;
wherein said plurality of multipoles comprise first, second and third multipoles, and
wherein said sample is positioned between said second and third multipoles.

25. A mass spectrometer according to claim 24, wherein said ionization source is selected from the group consisting of electrospray ionization source, nanospray ionization source, microspray ionization source, matrix assisted laser desorption/ionization, chemical ionization and electron ionization.

26. A mass spectrometer according to claim 24, wherein said plurality of multipoles further comprise at least one quadrupole.

27. A mass spectrometer according claim 24, wherein said mass analyzer is selected from the group consisting of time-of-flight (TOF) mass analyzer, fourier transform ion cyclotron resonance (FTICR) mass analyzer, quadrupole ion trap mass analyzer and coaxial multiple reflection TOF mass analyzer.

28. A mass spectrometer according to claim 24, wherein at least one of said first, second or third multipole comprises a quadrupole.

29. A mass spectrometer according to claim 24, wherein said first and second multipoles are arranged coaxially.

30. A mass spectrometer according to claim 24, wherein said sample is positioned at an angle to a co-axis of said first and second multipoles.

31. A mass spectrometer according to claim 24, wherein said third multipole contains a collision gas to fragment said ions.

32. A Q-SID-Q-TOF mass spectrometer comprising:

an ionization source to produce ions;

a plurality of multipoles comprising at least one quadrupole;

a collision surface for fragmenting said ions; and a time-of-flight mass analyzer to analyze said fragmented ions;

wherein said plurality of multipoles comprise one quadrupole and first and second multipoles, and wherein said collision surface is positioned between said quadrupole and said second multipole.

33. A Q-SID-Q-TOF mass spectrometer according to claim 32, wherein said ionization source is selected from the group consisting of electrospray ionization source, nanospray ionization source, microspray ionization source, matrix assisted laser desorption/ionization, chemical ionization and electron ionization.

34. A Q-SID-Q-TOF mass spectrometer according to claim 32, wherein a potential is applied between said ionization source and said collision surface to allow said ions to undergo surface induced dissociation.

35. A Q-SID-Q-TOF mass spectrometer according claim 32, wherein a potential is applied between said ionization source and said collision surface such that said ions pass through all of said multipoles without colliding with said collision surface.

36. A Q-SID-Q-TOF mass spectrometer according to claim 32, wherein said first multipole and said quadrupole are arranged coaxially.

37. A Q-SID-Q-TOF mass spectrometer according to claim 32, wherein said collision surface is positioned at an angle to a co-axis of said first multipole and said quadrupole.

38. A Q-SID-Q-TOF mass spectrometer according to claim 32, wherein said second multipole comprises a collision gas cell for collisionally cooling said fragmented ions.

39. A Q-SID-Q-TOF mass spectrometer according to claim 32, wherein said first multipole collisionally cools said ions.

40. A Q-SID-Q-TOF mass spectrometer according to claim 32, wherein a potential is applied between said ionization source and said collision surface such that said ions pass through all of said multipoles without colliding with said collision surface.

41. A Q-SID-Q-TOF mass spectrometer according to claim 32, wherein said second multipole contains a collision gas to fragment said ions.

42. A Q-SID-Q-TOF mass spectrometer according to claim 32, wherein said first multipole selects ions of a predetermined m/z range, wherein a potential is applied between said ionization source and said collision surface such that said selected ions will not collide with said collision surface, and wherein said second multipole contains a collision gas to fragment said selected ions.

* * * * *